US006564034B1

(12) United States Patent
Abe

(10) Patent No.: US 6,564,034 B1
(45) Date of Patent: May 13, 2003

(54) IMAGE FORMING DEVICE HAVING A CLEANING MEMBER FOR REMOVING TONER IN VARIABLE AMOUNTS FROM AN IMAGE BEARING MEMBER

(75) Inventor: Takuma Abe, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/453,534

(22) Filed: Dec. 3, 1999

(30) Foreign Application Priority Data

Dec. 8, 1998 (JP) ..... 10-349103

(51) Int. Cl.[7] ..... G03G 21/00
(52) U.S. Cl. ..... 399/350; 399/349
(58) Field of Search ..... 399/349, 350, 399/127, 148, 149; 15/256.5–256.52

(56) References Cited

U.S. PATENT DOCUMENTS

| | | | | |
|---|---|---|---|---|
| 3,918,808 A | * | 11/1975 | Narita | 399/149 |
| 4,269,503 A | * | 5/1981 | Nishikawa | 399/349 |
| 4,803,752 A | * | 2/1989 | Kasama | 15/256.51 |
| 4,912,351 A | | 3/1990 | Takata et al. | 310/323 |
| 5,083,169 A | | 1/1992 | Usui et al. | 355/296 |

FOREIGN PATENT DOCUMENTS

| | | | |
|---|---|---|---|
| EP | 0 578 427 | * | 6/1993 |
| JP | 57-35884 | | 2/1982 |
| JP | 62-197166 | | 12/1987 |
| JP | 1-185584 | | 7/1989 |
| JP | 2-191980 | | 7/1990 |
| JP | 3-107957 | | 5/1991 |
| JP | 3-130793 | * | 6/1991 |

OTHER PUBLICATIONS

Patent Abstract of JP 62–197166; Dec. 15, 1987.
Patent Abstracts of Japan 01–185584; Jul. 25, 1989.
Patent Abstracts of Japan 03–107957; Aug. 5, 1991.
Patent Abstracts of Japan 57–035884; Feb. 26,1982.
Patent Abstracts of Japan 02–191980; Jul. 27, 1990.

* cited by examiner

*Primary Examiner*—Quana M. Grainger
(74) *Attorney, Agent, or Firm*—Fitzpatrick, Cella, Harper & Scinto

(57) ABSTRACT

A cleaning device for removing residual toner on a surface of an electrophotographic photosensitive member includes a cleaning blade for scraping residual toner off the surface of the photosensitive member, and a toner supply portion, disposed in an upper stream side of the cleaning blade as viewed in a moving direction of the surface of the photosensitive member, for causing toner to stick to the surface of the photosensitive member, the toner supply portion being switchable between a first mode of causing toner to stick to the surface of the photosensitive member to supply toner to the nip between the surface of the photosensitive member and the cleaning blade and a second mode of not causing toner to stick to the surface of the photosensitive member or of decreasing an amount of toner to be stuck to the surface of the photosensitive member, the second mode being selectable when a main switch of an image forming apparatus having the cleaning device mounted therein has become turned on.

46 Claims, 6 Drawing Sheets

IMAGE FORMING DEVICE HAVING A CLEANING MEMBER FOR REMOVING TONER IN VARIABLE AMOUNTS FROM AN IMAGE BEARING MEMBER

BACKGROUND OF THE INVENTION

1. Field of the Invention

The present invention relates to a cleaning device for cleaning an image bearing member and to an image forming apparatus having the cleaning device, such as a copying machine, a laser printer, a facsimile device or the like.

2. Description of Related Art

An image forming apparatus such as a copying machine, a laser printer, a facsimile device or the like is generally arranged to form an electrostatic latent image on the surface of a photosensitive drum (an image bearing member), to develop (visualize) the electrostatic latent image into a toner image by applying toner to the electrostatic latent image, to transfer the toner image to a transfer member such as paper or the like, and to fix the image transferred by heating. With the image forming apparatus arranged in this manner, after the transfer of the toner image, the photosensitive drum has some remnant toner remaining untransferred on the surface thereof and also some powdery remnants of paper such as fiber or some components of paper sticking thereto. These sticking matters are removed and recovered from the photosensitive drum by means of a cleaning device.

A cleaning device which is popular among other known cleaning devices is arranged to scrape such sticking matters off the surface of the photosensitive drum, i.e., the image bearing member, by causing a cleaning blade (cleaning member) to abut on the image bearing member.

The known cleaning device is sometimes provided with an auxiliary member for making it capable of more stably carrying on its cleaning function. The auxiliary member is, for example, a magnetic toner brush (toner supply means). The magnetic toner brush is arranged, on the lower stream side of the cleaning blade in the rotating direction of the photosensitive drum, to resupply the cleaning blade with the toner scraped off by the cleaning blade from the surface of the photosensitive drum. With the scraped-off toner re-supplied in this manner, a predetermined amount of toner can always be supplied to a nip between the surface of the photosensitive drum and the cleaning blade to ensure a stable friction coefficient between the two members at the nip, so that the cleaning function can be stably carried out.

The arrangement of the above-stated image forming apparatus having the magnetic toner brush is, however, ineffective in undoing a fused sticking of the toner to the surface of the photosensitive drum in cases where the toner tends to stick to the surface of the photosensitive drum (including electrostatic sticking). The cause of this problem is considered to be as follows. In a case where toner sticks to the surface of a photosensitive drum due to the uneven surface condition of the photosensitive drum or the like, the amount of toner supplied to the fused sticking part by the magnetic toner brush becomes larger than the amount of toner removed at the nip between the photosensitive drum surface and the cleaning blade. As a result, the fused sticking of toner increases. It is known that this phenomenon tends to take place under a high-temperature and high-humidity ambient conditions. Further, since the toner is sticking to the photosensitive drum, the condition of the surface of the photosensitive drum also has a great influence on this phenomenon. Therefore, the fused sticking of toner is apt to take place particularly in a case where a photosensitive drum having a long durability is used under a high-temperature and high-humidity ambient condition.

BRIEF SUMMARY OF THE INVENTION

The present invention has been made in view of the above circumstances, and an object of the invention is to provide a cleaning device capable of preventing a fused sticking of toner to an image bearing member (a photosensitive drum), and an image forming apparatus using the cleaning device.

To attain the above object, in accordance with an aspect of the invention, there is provided a cleaning device for removing residual toner from a surface of an electrophotographic photosensitive member after a transfer process, the cleaning device comprising a cleaning blade composed of an elastic member for scraping residual toner off the surface of the photosensitive member by abutting on the surface of the photosensitive member, and toner supply means, disposed in an upper stream side of the cleaning blade as viewed in a moving direction of the surface of the photosensitive member, for supplying toner to a nip between the surface of the photosensitive member and the cleaning blade by causing toner to stick to the surface of the photosensitive member, the toner supply means including switching means for switching the toner supply means between a first mode of causing toner to stick to the surface of the photosensitive member to supply toner to the nip between the surface of the photosensitive member and the cleaning blade and a second mode of not causing toner to stick to the surface of the photosensitive member, or of decreasing an amount of toner to be stuck to the surface of the photosensitive member, the second mode being selectable when a main switch of an image forming apparatus having the cleaning device mounted therein has become turned on.

Further, according to another aspect of the invention, there is provided an image forming apparatus using the above cleaning device.

These and further objects and features of the invention will become apparent from the following detailed description of preferred embodiments thereof taken in conjunction with the accompanying drawings.

DETAILED DESCRIPTION OF THE INVENTION

Hereinafter, preferred embodiments of the invention will be described in detail with reference to the drawings.

First Embodiment

Figure 1:
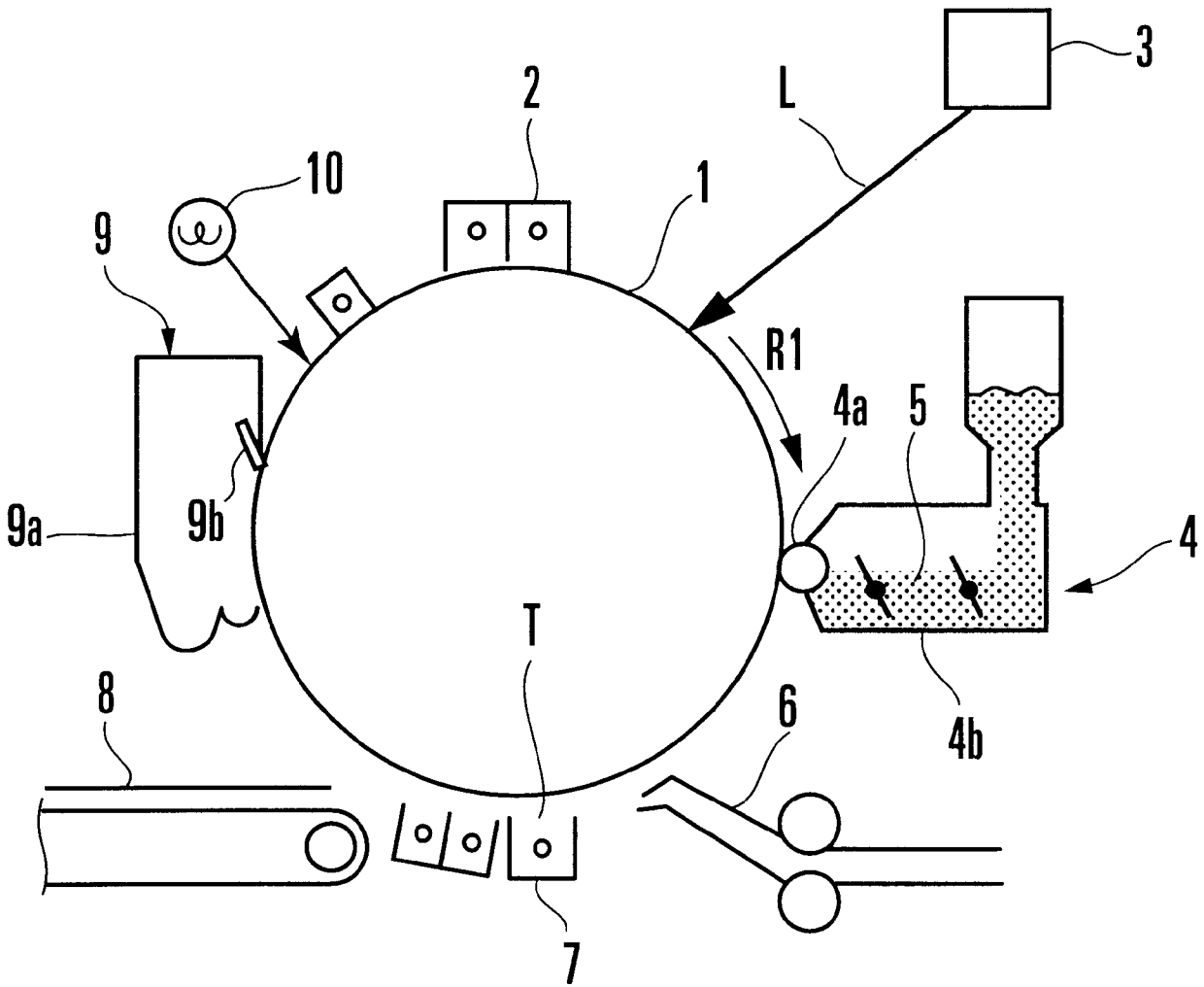
FIG. 1 is a vertical sectional view showing in outline the arrangement of an image forming apparatus.

FIG. 1 is a schematic vertical sectional view showing in outline the arrangement of an image forming apparatus, such as a copying machine or a laser printer, according to the invention.

The image forming apparatus shown in FIG. 1 has, as an image bearing member, a drum-type electrophotographic photosensitive member (hereinafter referred to as a photosensitive drum) 1. The photosensitive drum 1 is formed by applying a photosensitive layer of an OPC (organic photosemiconductor) to the surface of a drum base made of aluminum or the like. A drum driving motor (not shown) is arranged to drive the photosensitive drum 1 to rotate in the direction of arrow R1 at a process speed of, for example, 340 mm/sec.

The surface of the photosensitive drum 1 is arranged to be charged (electrified) by a charging device 2. The charging device 2 shown in FIG. 1 is of a scorotron type and is disposed opposite to the surface of the photosensitive drum 1. The surface of the photosensitive drum 1 is uniformly charged to have a predetermined polarity and a predetermined potential by applying a charging bias to the charging device 2 from a charging bias applying power source (not shown).

Exposure means 3 is disposed on the lower stream side of the charging device 2 as viewed in the rotating direction of the photosensitive drum 1 (in the direction of arrow R1). For example, a laser scanner is employed as the exposure means 3. The laser scanner performs a scanning exposure action on the charged surface of the photosensitive drum 1 to form an electrostatic latent image thereon with a laser beam which is on/off-controlled according to image information in such a way as to remove electric charge of surface parts illuminated with the laser beam.

A developing device 4, which is disposed further downstream from the exposure means 3, is provided with a developing roller 4*a* which has a magnet (magnetic field generating means) arranged on its inner side. The developing roller 4*a* is arranged to friction-charge toner 5, which is stored in a developing container 4*b*, bear on its surface a thin layer of the toner 5 and convey the thin layer of the toner 5 to a developing position opposed to the surface of the photosensitive drum 1. A charging (electrifying) bias is applied to the developing roller 4*a* by a developing bias applying power source (not shown), so that the toner 5 which has been conveyed to the developing position is caused to stick to the electrostatic latent image, thereby developing the electrostatic latent image into a toner image.

Here, the details of the toner 5 are described. The toner used in the present invention is a magnetic toner (toner having magnetism), which is manufactured as follows. A mixture is obtained by mixing 100 parts by weight of a copolymer of styrene-butylmethacrylate-dimethylalminoethylmethacrylate (in a ratio by weight of 7:2.5:0.5), 40 parts by weight of magnetite which is 5 $m^2/g$ in BET surface area and 5.5 in Mohs' scale of hardness, and 3 parts by weight of polypropylene which is 15000 in weight-average molecular weight having 20 percent by weight of a hexane extract of n boiling point. The mixture thus obtained is fused and kneaded at 160° C. by a roll mill. After cooling, the mixture is coarsely crushed by a hammer mill and is then finely pulverized by a jet pulverizer. A powder thus obtained is classified by a pneumatic classifier to obtain a fine black powder, as a black magnetic toner, measuring about 7.5 $\mu$m in average volume particle diameter.

Meanwhile, 100 parts by weight of a fine powder of silica synthesized by a dry process (to be about 130 $m^2/g$ in specific surface area) is stirred. While the stirring is in process, 12 parts by weight of silicone oil having amine at its side chain (having 70 cps in viscosity at 25° C. and 830 in amine equivalent) are sprayed on the silica powder. This treating process is carried on for 60 min. while keeping temperature at about 250° C. The amount of tribo-charge of the treated silica obtained by a test was +130 $\mu$c/g. The hardness of the silica thus obtained was 6.0 in Mohs' scale of hardness.

A magnetic toner is obtained by adding, to 100 parts by weight of the magnetic toner from outside, 0.4 parts by weight of the silica fine powder, which was treated with the silicone oil having amine at its side chain, and 0.05 parts by weight of polyvinylidene fluoride (PVDF).

A transfer guide 6 and a transfer/separation charger 7 are disposed on the lower stream side of the developing device 4. A transfer member 8 which is paper or the like is fed to a transfer part T between the transfer/separation charger 7 and the photosensitive drum 1 by the aid of the transfer guide 6. The transfer/separation charger 7 is arranged to operate by utilizing corona discharge to transfer the toner image to the transfer member 8 from the photosensitive drum 1 and to separate the transfer member 8 having the toner image transferred thereto from the photosensitive drum 1. The polarity of the corona discharge, i.e., a transfer bias, used for the transfer is of a polarity opposite to that of the toner 5. The polarity of the corona discharge, i.e., a separation bias, used for the separation is the same as that of the toner 5. These biases are applied respectively from a transfer bias applying power source and a separation bias applying power source which are not shown.

A cleaning device 9 according to a first embodiment of the invention is located furthest on the lower stream side of the transfer part T in the direction of rotation of the photosensitive drum 1. The cleaning device 9 is arranged to recover the toner remaining on the photosensitive drum 1 after transfer of the toner image (transfer residual toner).

Figure 2:
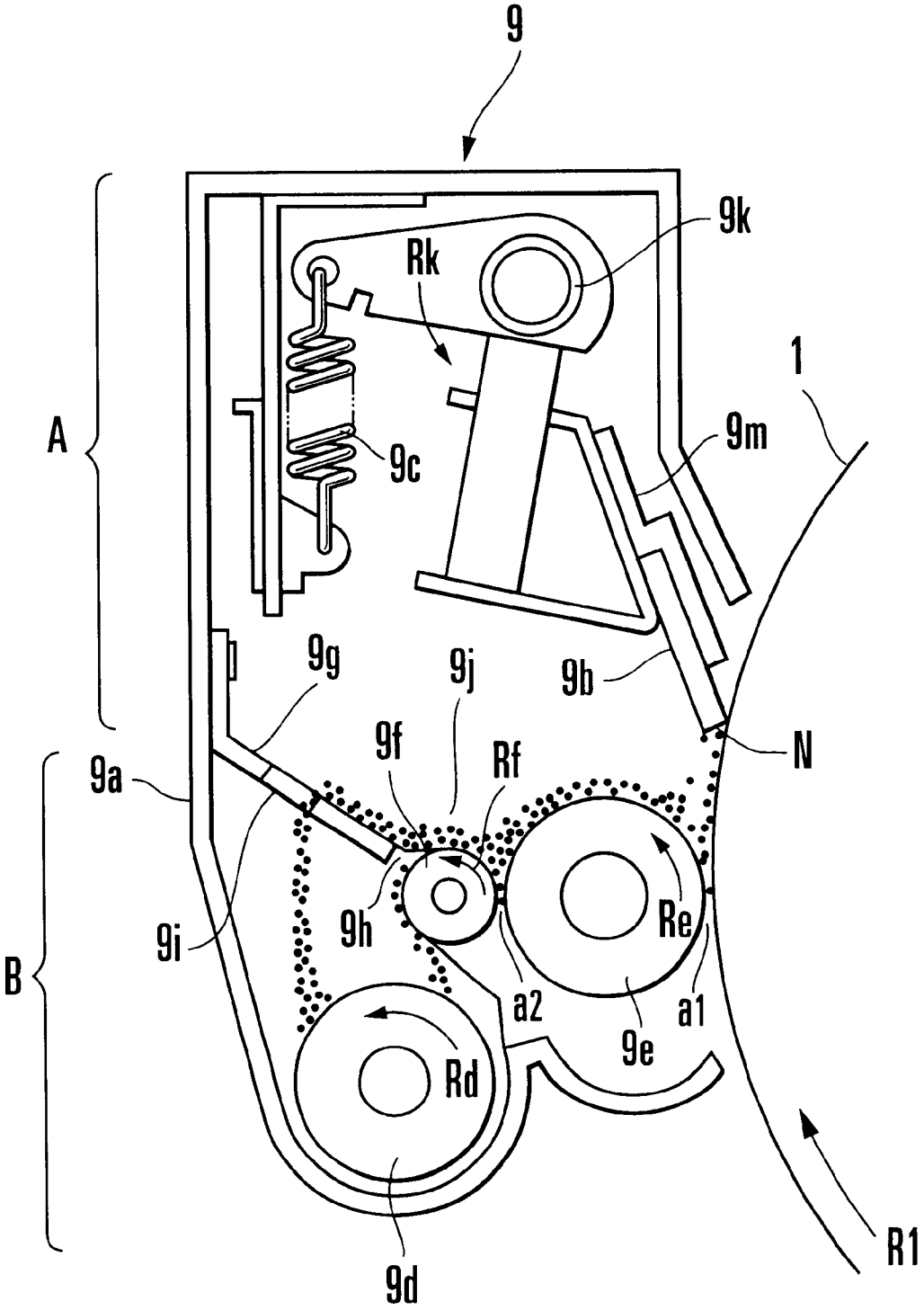
FIG. 2 is a vertical sectional view showing the arrangement of a cleaning device according to a first embodiment of the invention.

The details of the cleaning device 9 are described with reference to FIG. 2. FIG. 2 is a vertical sectional view taken along a line orthogonally intersecting the generating line of the photosensitive drum 1 to show the arrangement of the cleaning device 9.

The cleaning device 9 is provided with a cleaning means A and a toner supply means B. The toner scraped off by the cleaning means A is recovered in a recovery box (not shown) disposed within the body of the image forming apparatus. A part of the toner scraped off is not recovered but is supplied as a lubricant to the cleaning means A by the toner supply means B at predetermining timing. The details of this operation are as follows.

The cleaning means A has a cleaning blade 9*b* which is made of a plate-like elastic member. The cleaning blade 9*b* is held by a holder 9*m* which is arranged to swing on a shaft 9*k*. A tension spring 9*c* is arranged to urge the holder 9*m* to swing in the direction of arrow Rk. As a result, the cleaning blade 9*b* is made to abut on the surface of the photosensitive drum 1 with a predetermined abutting pressure. At the abutting part where the cleaning blade 9*b* abuts on the surface of the photosensitive drum 1, there is formed a linear nip N along the generating line of the photosensitive drum 1. The nip N is formed on the left side of the photosensitive drum 1 as viewed in FIG. 2. Accordingly, the transfer residual toner sticking to the surface of the photosensitive drum 1 is scraped off by the cleaning blade 9*b* at the nip N to fall down by its own weight.

The toner supply means B has a cleaning roller 9*e* serving as a toner bearing member. The cleaning roller 9*e* is disposed on the upper stream side of the cleaning blade 9*b* in the direction of the moving direction of the surface of the photosensitive drum 1 and below the cleaning blade 9*b*. The cleaning roller 9*e* is a magnet roller which is a magnet formed in a roller shape, and is arranged to be rotated in the direction of arrow Re which is reverse to the rotating direction of the photosensitive drum 1 indicated by the arrow R1. The moving direction of the surface of the photosensitive drum 1 and that of the surface of the cleaning roller 9*e*, therefore, come to coincide with each other where they come nearest to each other. The cleaning roller 9*e* is arranged to be away from and not in contact with the photosensitive drum 1. A gap $a_1$ which measures, for example, 2 mm is provided between the surface of the cleaning roller 9*e* and the surface of the photosensitive drum 1. The toner which has been scraped off by the cleaning blade 9*b* and has fallen downward is carried by the surface of the cleaning roller 9*e* to be moved in the direction of arrow Re.

A doctor roller 9f is disposed on the left side of the cleaning roller 9*e* as viewed in FIG. 2. A toner buffer member 9*g* is disposed on the left side of the doctor roller 9*f*. Further, a toner transport screw 9*d* is disposed below the doctor roller 9*f* and the toner buffer member 9*g*. The doctor roller 9*f* is made from a nonmagnetic bar and is arranged to rotate in the direction of arrow Rf which is the same as the rotating direction of the cleaning roller 9*e* indicated by the arrow Re. Therefore, the surface of the cleaning roller 9*e* and the surface of the doctor roller 9*f* rotate in opposite directions at a part where they come nearest to each other. The toner carrying power of the rotation of the doctor roller 9*f* is low, while the toner buffer member 9*g* is slanting downward on the side of the doctor roller 9*f*. Therefore, a toner pool 9*j* of the recessed shape is formed jointly by the doctor roller 9*f* and the toner buffer member 9*g*. A gap $a_2$ which measures, for example, 2.5 mm and is larger than the above-stated gap $a_1$ (2 mm) is provided between the surface of the doctor roller 9*f* and the surface of the cleaning roller 9*e*.

A gap 9*h* is provided between the surface of the doctor roller 9*f* and the fore end of the toner buffer member 9*g*. Further, a slit 9*i* is provided on the base end side of the toner buffer member 9*g*. An excessive portion of toner gathered in the toner pool 9*j* is thus made to fall down to the toner transport screw 9*d* through the gap 9*h* and the slit 9*i*. The toner screw 9*d* is arranged to convey the fallen toner to a waste toner recovery box (not shown) disposed inside the body of the image forming apparatus.

The cleaning device 9 arranged as described above operates as described below.

The transfer residual toner (remnant toner after the transfer process) sticking to the surface of the photosensitive drum 1 is scraped off by the cleaning blade 9*b* at the nip N. The scraped toner falls on the cleaning roller 9*e* and sticks thereto. The toner sticking to the cleaning roller 9*e* is conveyed by the rotation of the cleaning roller 9*e* to the doctor roller 9*f*. Then, the flow of toner is dammed up by the toner buffer member 9*g* to be temporarily detained there. After that, the detained toner comes to fall down to the toner transport screw 9*d* from the gap 9*h* and the slit 9*i*. The fallen toner is recovered in the waste toner recovery box by the rotation of the toner transport screw 9*d* in the direction of arrow Rd.

The photosensitive drum 1 rotates at a peripheral speed of 340 mm/sec in the direction of arrow R1. The cleaning roller 9*e* rotates at a peripheral speed of 30 mm/sec in the direction of arrow Re. The doctor roller 9*f* rotates at a peripheral speed of 3 mm/sec in the direction of arrow Rf. The toner transport screw 9*d* rotates at a suitable rotational frequency in the direction of arrow Rd.

According to the rotation of the cleaning roller 9*e* and the doctor roller 9*f*, the toner which is carried and conveyed on the surface of the cleaning roller 9*e* by the magnetic force thereof has its layer thickness restricted to 2.5 mm on the surface of the cleaning roller 9*e* by the gap $a_2$ (measuring 2.5 mm) between the surface of the cleaning roller 9*e* and the surface of the doctor roller 9*f* as mentioned above. When the cleaning roller 9*e* further rotates under this condition, the toner which is restricted to 2.5 mm in layer thickness is conveyed to the gap al between the surface of the cleaning roller 9*e* and the surface of the photosensitive drum 1. Then, since the gap $a_1$ is 2 mm, the toner comes into contact with the surface of the photosensitive drum 1 to coat the surface of the photosensitive drum 1 therewith. The toner coat on the surface of the photosensitive drum 1 is then supplied by the rotation of the photosensitive drum 1 to the nip N of the cleaning blade 9*b* which is abutting on the surface of the photosensitive drum 1. Then, the supply of the toner coat to the nip N ensures uniform smoothness of the cleaning blade 9*b*. In this instance, the temporary detention or residence of the toner at the toner pool 9*j* mentioned above stabilizes the detained amount of toner on the surface of the cleaning roller 9*e* to eventually form a uniform toner coat on the surface of the photosensitive drum 1, so that the amount of toner supplied to the nip N can be stabilized to ensure the uniform smoothness of the cleaning blade 9*b*. The toner pool 9*j* thus serves to stabilize the toner coat to play an important role in preventing the warp and chatter of the cleaning blade 9*b*.

Figure 3:
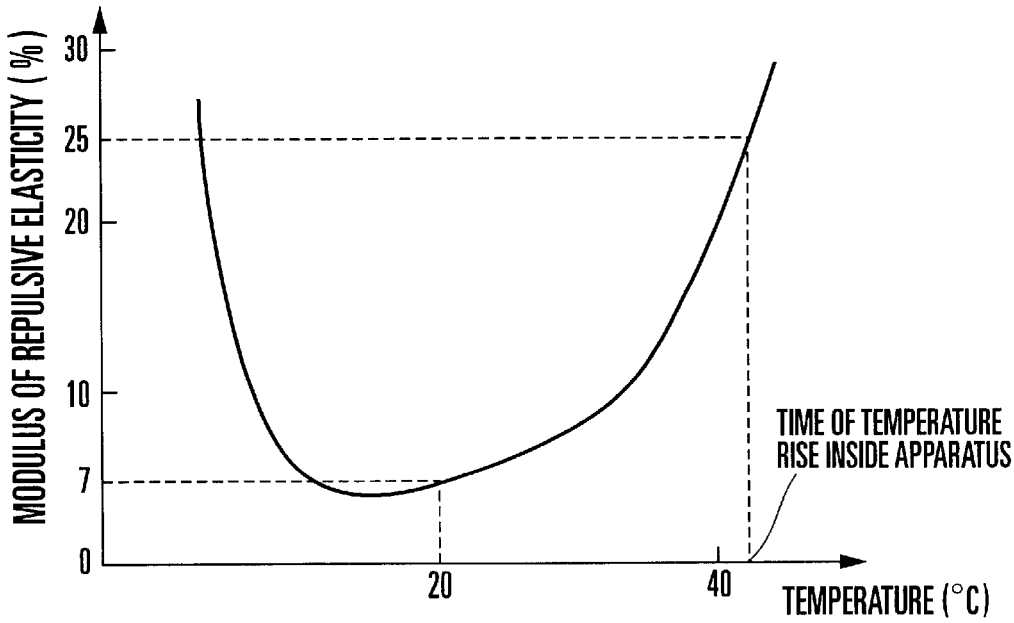
FIG. 3 is a diagram showing the relationship between the modulus of repulsive elasticity of a cleaning blade and temperature.

The modulus of repulsive elasticity of the cleaning blade 9*b* has a such characteristic that varies as shown in FIG. 3 with respect to temperature. Generally, if the modulus of repulsive elasticity of the cleaning blade 9*b* is low, the cleaning blade 9*b* has a low response to an impact applied from outside. If there is some protrusion on a smooth plane surface, for example, the part of the cleaning blade 9*b* abutting on the smooth plane surface, such as the surface of the photosensitive drum 1, deforms at a slow speed against the protrusion. In the event of such a protrusion, the abutting part of the cleaning blade 9*b* strongly collides with the protrusion to scratch off the protrusion. Therefore, fine protrusions and recessions of the surface of the photosensitive drum 1 are shaved away by the cleaning blade 9*b* to have the whole surface layer of the photosensitive drum 1 polished.

In a case where the modulus of repulsive elasticity of the cleaning blade 9*b* is high, on the other hand, the abutting part of the cleaning blade 9*b* quickly deforms when the cleaning blade 9*b* comes to collide with some protrusion of the surface of the photosensitive drum 1. Therefore, an impact to the protrusion is weak, and the quick deformation allows the abutting part of the cleaning blade 9*b* to override the protrusion. The cleaning blade 9*b* responds in this manner not only to protrusions but also to the toner sticking to the surface of the photosensitive drum 1. In this case, therefore, the cleaning blade 9*b* has a low power of annulling the sticking of the toner, while the cleaning blade 9*b* is damaged to a less extent by the protrusions and recessions of the surface of the photosensitive drum 1.

In the case of the first embodiment, when the photosensitive drum 1 is driven to rotate, the cleaning roller 9*e* is also rotated as a rule and the toner is supplied from the cleaning roller 9*e* to the nip N of the cleaning blade 9*b* through the surface of the photosensitive drum 1. The operation of the image forming apparatus performed in this manner hereinafter will be called a first mode.

However, in the event of a condition described below, the toner is made not to be supplied to the nip N by selecting a second mode after the main switch of the image forming apparatus is turned on.

In a case where the atmosphere temperature (ambient temperature) of the cleaning blade 9*b* is low, for example, before the inside temperature of the image forming apparatus body rises to a certain temperature level, the cleaning blade 9*b* is abutting on the photosensitive drum 1 in a state of having a low modulus of repulsive elasticity. When the photosensitive drum 1 is driven by a drum driving motor (not shown) under this condition, if there is some fused sticking toner on the surface of the photosensitive drum 1, the sticking toner can be readily scraped off the surface of the photosensitive drum 1 by the collision of the cleaning blade 9*b* with the sticking toner. The second mode is selected in the event of low ambient temperature to cause the photosensitive drum 1 to rotate and, on the other hand, to keep the cleaning roller 9*e* at a stop. Then, the toner is made not to be supplied from the cleaning roller 9*e* to the surface of the photosensitive drum 1.

Figure 4:
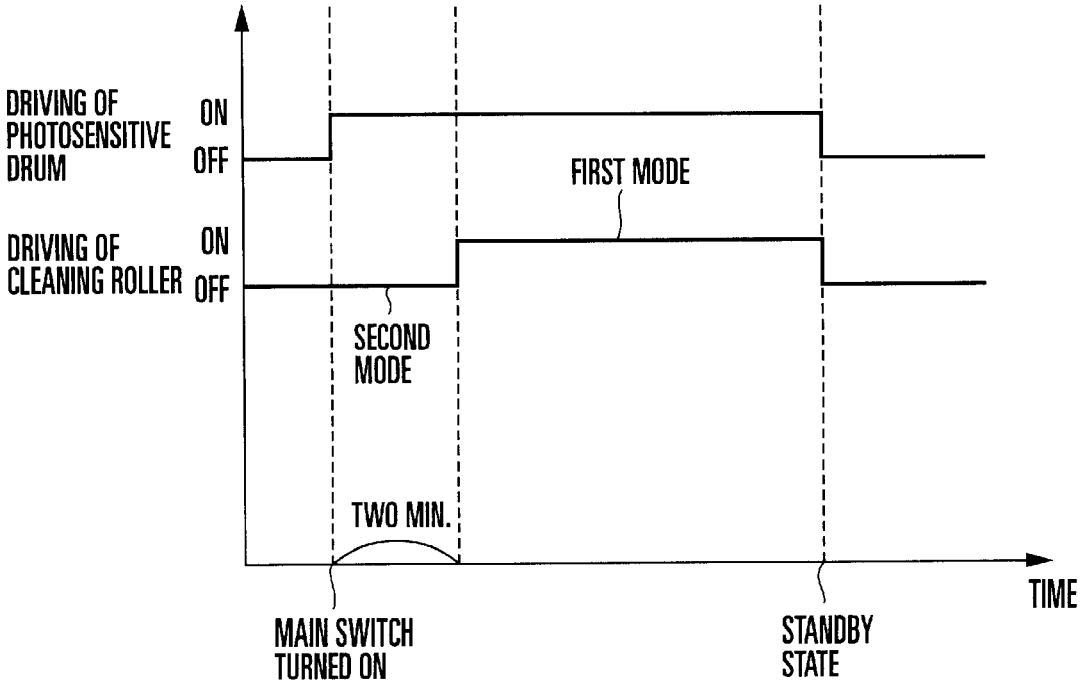
FIG. 4 is a timing chart showing the operation timing of a cleaning roller in the first embodiment.

When the ambient temperature of the cleaning blade 9*b* is low, the photosensitive drum 1 alone is thus caused to rotate for a predetermined period of time. As shown in FIG. 4, the predetermined period of time is set to two minutes immediately after the main switch of the image forming apparatus is turned on. The temperature of the cleaning blade 9*b* is caused to rise up to 45° C. or thereabout by the rise of the inside temperature of the image forming apparatus. However, with the image forming apparatus not in use, the temperature of the cleaning blade 9*b* is normally equal to the atmosphere temperature of the image forming apparatus. As apparent from FIG. 3, when the temperature of the cleaning blade 9*b* is 45° C., the modulus of repulsive elasticity of the cleaning blade 9*b* is 25%. With the atmosphere temperature of the image forming apparatus assumed to be 20° C., when the image forming apparatus is not in use, the modulus of repulsive elasticity of the cleaning blade 9*b* is 7%. Although this example of operation is not shown in any flowchart, a flowchart shown in FIG. 7 applies to this example of operation as it is, if a step S2 of the flowchart of FIG. 7 is replaced with a step of making a check "[I]s the atmosphere temperature less than a predetermined temperature?" and the predetermined temperature is set to a suitable value.

Conditions under which the above-stated second mode is changed over to the first mode include a case where the ambient atmosphere of the image forming apparatus has a moisture content of 15 g/kg(Air) or more and is a so-called high-temperature and high-humidity environment. Under such an environment condition, fused sticking of toner tends to take place, because, when the toner absorbs moisture, affinity of the toner increases, and besides, the surface of the photosensitive drum 1 becomes more readily reactive.

Figure 7:
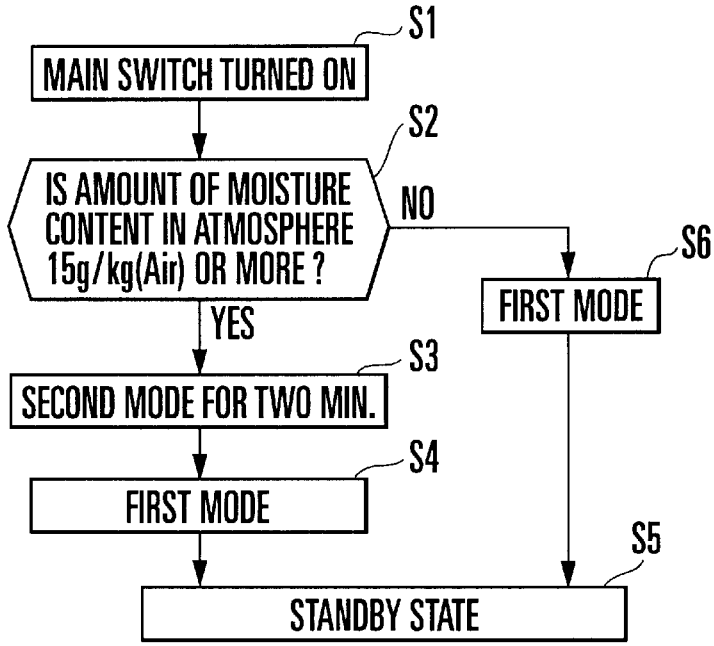
FIG. 7 is a flowchart showing the operation of the cleaning device in the first embodiment.
Figure 8:
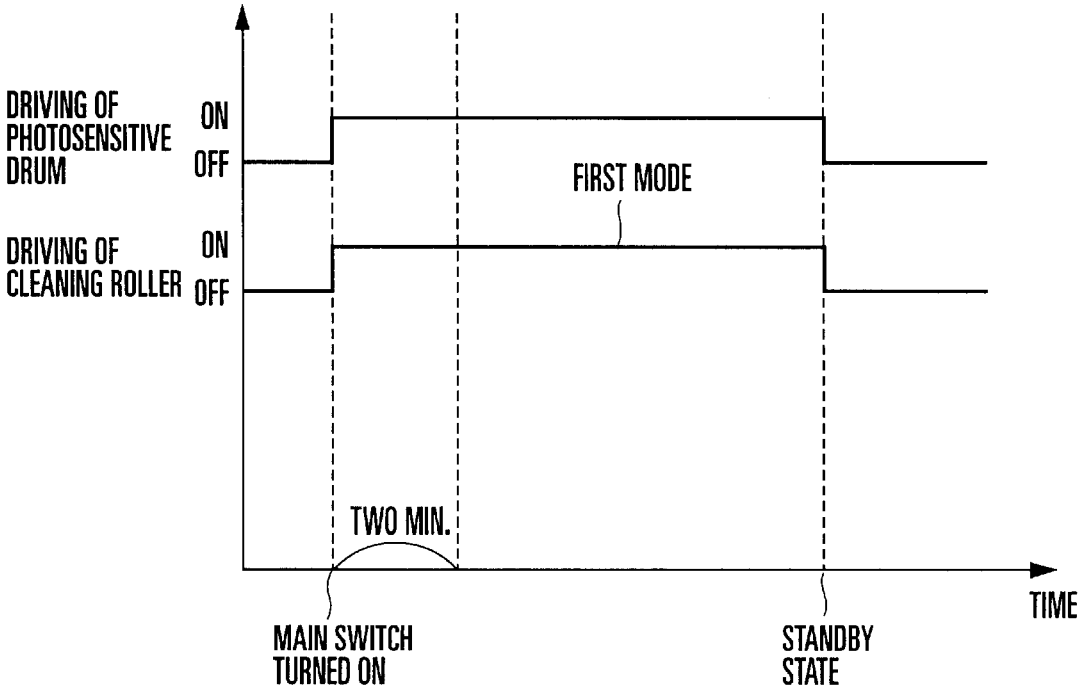
FIG. 8 is a timing chart showing the operation timing of the cleaning roller in a case where a second mode is not selected in the first embodiment.

The operation in such a case according to the first embodiment is shown in the flowchart of FIG. 7. Referring to FIG. 7, the main switch of the image forming apparatus is turned on at a step S1. At a step S2, a check is made to find if the moisture content of the ambient atmosphere is 15 g/kg (Air) or more. If so, the flow of operation proceeds to a step S3. At the step S3, the second mode is selected to supply no toner to the nip N for a period of two minutes. After that, the flow proceeds to a step S4 to select the first mode. At a step S5, the image forming apparatus assumes a standby state. Further, if the moisture content of the ambient atmosphere is found at the step S2 to be less than 15 g/kg (Air), the flow proceeds from the step S2 to a step S6. At the step S6, the first mode is selected, i.e., the second mode is not selected. FIG. 8 shows, in a timing chart, the operation of the image forming apparatus in a case where the second mode is not selected.

Second Embodiment

Figure 5:
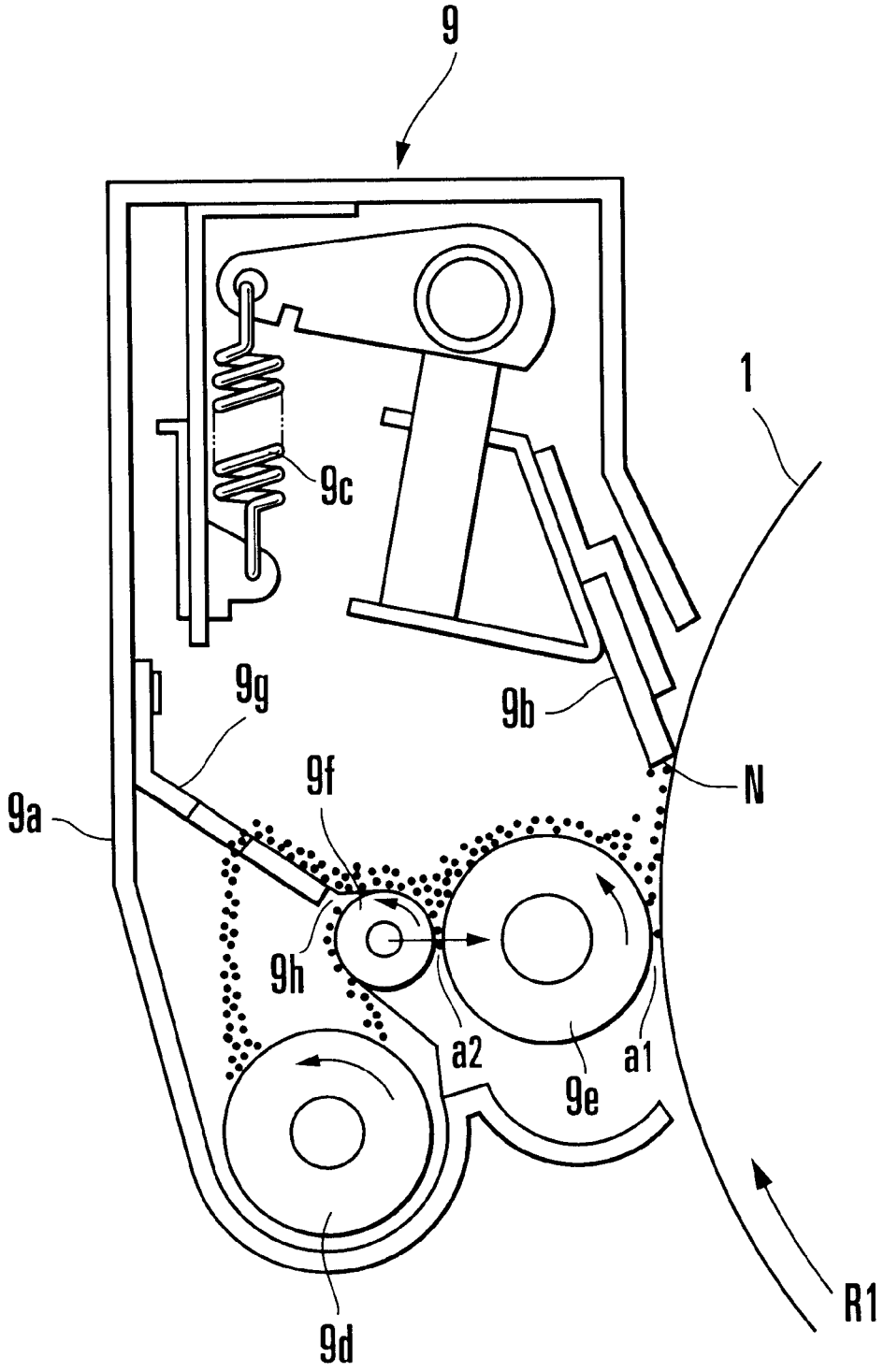
FIG. 5 is a vertical sectional view showing the arrangement of a cleaning device according to a second embodiment of the invention.

FIG. 5 shows the arrangement of a second embodiment of the invention. All parts of the second embodiment that are the same as those of the first embodiment are indicated by the same reference numerals. In the case of the second embodiment, as shown in FIG. 5, the doctor roller 9*f* is arranged to be movable with respect to the cleaning roller 9*e* in such a way as to permit switching between the first mode and the second mode by varying the gap $a_2$ between the cleaning roller 9*e* and the doctor roller 9*f*.

Referring to FIG. 5, when the main switch of the image forming apparatus is turned on for the first time in the morning, for example, of a certain day (during blank rotation in the morning), the doctor roller 9*f* is made to move toward the cleaning roller 9*e* in such a way as to bring the image forming apparatus into a state of having no toner sticking to the photosensitive drum 1 by reducing the layer thickness of a magnetic toner coat on the cleaning roller 9*e*. The object of the invention is attainable by thus bringing the image forming apparatus into this state.

In a case where an image forming apparatus is arranged to drive both the photosensitive drum 1 and the cleaning roller 9*e* by a single main driving motor (not shown), the image forming apparatus cannot be arranged like the first embodiment described in the foregoing.

Therefore, in order to prevent the photosensitive drum 1 from being re-coated with the toner, in spite of a state in which both the photosensitive drum 1 and the cleaning roller 9*e* are rotating, the toner on the cleaning roller 9*e* must be prevented from coming into contact with the surface of the photosensitive drum 1, because the surface of the photosensitive drum 1 is arranged to be re-coated with the toner by coming into contact with the cleaning roller 9*e*.

In the case of the second embodiment, the parts around the cleaning roller 9*e* are arranged as follows. When the image forming apparatus is in an ordinary image forming operation, the gap $a_1$ between the circumferential surface of the cleaning roller 9*e* and the surface of the photosensitive drum 1 is 2.0 mm, while the gap $a_2$ between the surface of the doctor roller 9*f* and the cleaning roller 9*e* is arranged to be 2.5 mm to allow the toner layer formed on the cleaning roller 9*e* by the gap $a_2$ to intrude on the surface of the photosensitive drum 1 in an amount corresponding to a gap difference of 0.5 mm.

Figure 6:
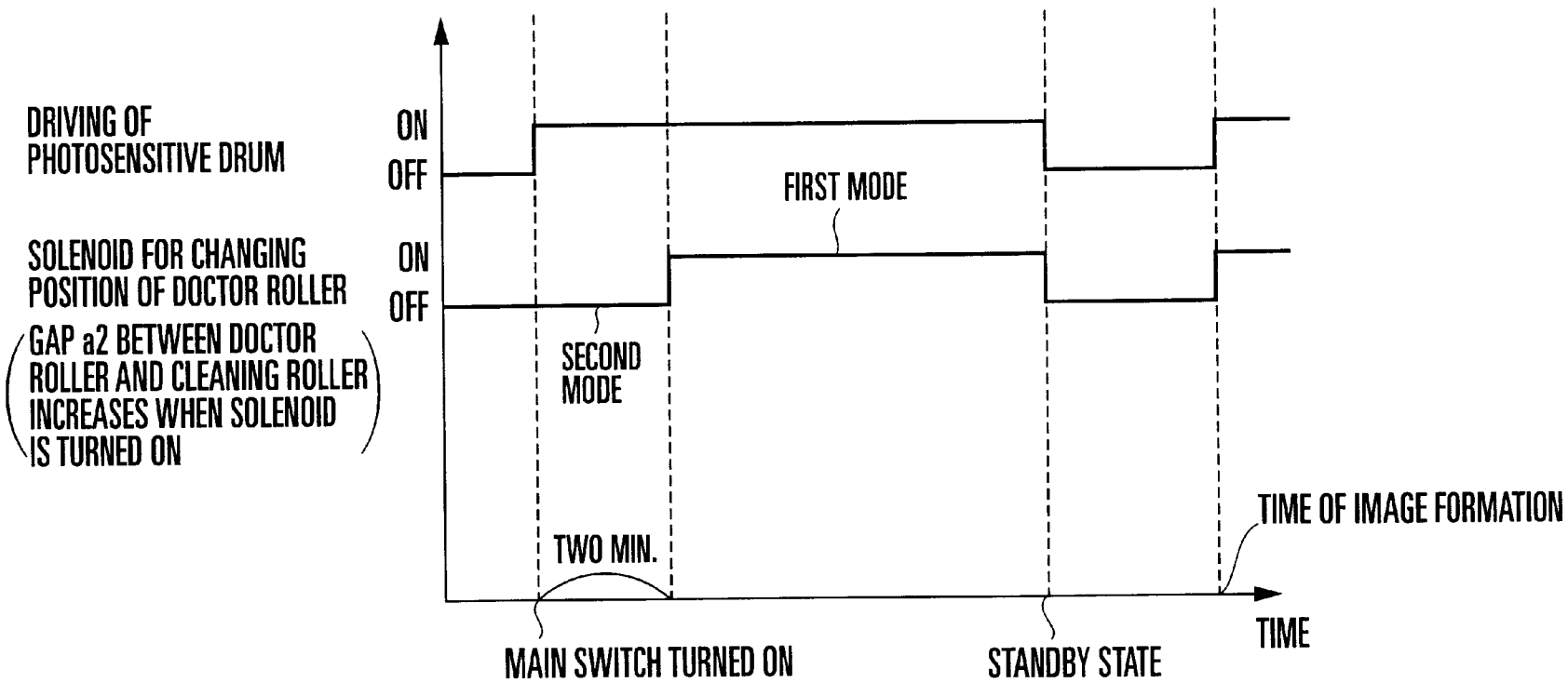
FIG. 6 is a timing chart showing the operation timing of a solenoid for changing the position of a doctor roller in the second embodiment.

On the other hand, in a case where the photosensitive drum 1 must be prevented from being coated with the toner, the position of the doctor roller 9*f* is arranged to be moved 1.0 mm toward the cleaning roller 9*f* by means of a solenoid magnet (see FIG. 6) to change the size of the gap $a_2$ from 2.5 mm to 1.5 mm, which is smaller than the gap $a_1$ which is 2.0 mm. By virtue of this arrangement, the toner layer on the cleaning roller 9*e* can be prevented from coming into contact with the surface of the photosensitive drum 1.

The second embodiment is arranged to bring about a state in which the photosensitive drum 1 is prevented from being re-coated with the toner as mentioned above. The timing of bringing about this state is the same as in the case of the first embodiment. The arrangement of the second embodiment also gives the same advantageous effect as the effect attainable by the first embodiment.

Third Embodiment

It is popularly practiced to raise the amount of electric charge of toner by causing the developing roller 4*a* of the developing device 4 to rotate for a certain period of time immediately after the main switch of the image forming apparatus is turned on. This process is performed for the purpose of adequately forming images without fail from the start of operation each day, i.e., from the start of operation in the morning (hereinafter referred to as a first-morning image forming operation).

In the case of the invention, however, causing the developing roller 4*a* of the developing device 4 to rotate means supply of the toner onto the photosensitive drum 1. Then, the toner on the developing roller 4*a* is electrified (charged with electricity) to bring about electrostatic attraction for the photosensitive drum 1.

Since it is intended by a third embodiment of the invention to allow the cleaning blade 9*b* to abut on the photosensitive drum 1 for a predetermined period of time in a state of having the photosensitive drum 1 coated with no toner, if even a slight amount of toner is sticking to the photosensitive drum 1 during this period, the advantageous effect aimed at by the invention would be lowered.

In view of this, the third embodiment is arranged to further improve the first and second embodiments to more adequately carry out the first-morning image forming operation while retaining the advantageous effect of the invention. In performing the first-morning operation by the blank rotating process of the first and second embodiments, the third embodiment is arranged to synchronize the rotation of the developing roller 4*a* of the developing device 4 with the blank rotation and, after that, to apply a bias in a direction reverse to the developing direction of the image forming operation. This arrangement enables the third embodiment to bring about a state in which no toner is supplied to the photosensitive drum 1, so that a good-quality image formation can be performed from the beginning of the first-morning operation.

More specifically, the third embodiment uses a positively charged magnetic toner for developing. In the third embodiment, therefore, a magnet roller is arranged within the developing roller 4*a* to exert a magnetic force for conveying the toner and carrying out the developing process by an electromagnetic force. The details of this developing operation are omitted from the description given here.

With the third embodiment arranged in this manner, a charging condition is set in such a way as to have the potential of the surface of the photosensitive drum 1 at about 400 V after charging by the charging device 2. The amount of exposure is adjusted to have the potential at 50 V after a uniform exposure. At the developing device 4, the developing bias is arranged to have an AC component of 1.0 $kV_{pp}$ having a rectangular wave of 2.7 kHz in frequency and 40% in duty and to have a DC component of 280 V. During a predetermined period of time immediately after turning-on of the main switch of the image forming apparatus and while the developing roller 4*a* of the developing device 4 is rotating, the developing bias is arranged to have no AC component and have its DC component at −100 V. Further, during this period, no charging action is performed by the charging device 2, and the surface potential of the photosensitive drum 1 is caused to be 50 V or less by a pre-exposure device 10 (see FIG. 1) which is disposed on the lower stream side of the cleaning device 9.

Therefore, the potential of the surface of the photosensitive drum 1 is higher by 150 V than that of the developing roller 4*a* of the developing device 4. The electric charge of the toner causes the toner to be pulled to the developing roller 4*a* of the developing device 4, so that the toner is effectively prevented from sticking to the photosensitive drum 1. This effect is attainable because a centrifugal force generated by the rotation of the developing roller 4*a* of the developing device 4 is overcome by the attraction of magnetic and electric fields. The magnetic flux density of the surface of the developing roller 4*a* of the developing device 4 employed in the third embodiment is 100 mT (millitesla).

Fourth Embodiment

The embodiments described above are arranged to always cause the photosensitive drum 1 to rotate alone for two minutes when the main switch of the image forming apparatus is turned on.

However, in cases where the main switch is set in its off-state only for a brief period of time or where the supply of power is just temporarily cut off due to some trouble or the like, the above-stated arrangement is not efficient, because it necessitates the photosensitive drum 1 to be rotated for two minutes every time the main switch is turned on again. Further, if the sole rotating action on the photosensitive drum 1 is performed when only a few images are formed after the initial sole rotation of the photosensitive drum 1, the toner sticking phenomenon to be eliminated according to the invention has not occurred as yet. Besides, at that time, the sticking-toner removing power of the cleaning blade 9*b* is still low as the inside temperature of the image forming apparatus has not dropped as yet. In such a case, the arrangement would cause the photosensitive drum 1 to be uselessly rotated alone.

To solve this problem, a fourth embodiment of the invention is arranged to detect the temperature of a fixing device (not shown) which is in close relation to the inside temperature of the image forming apparatus and to perform the process of "singly rotating the photosensitive drum 1" for a predetermined period of time only when the detected temperature of the fixing device is not exceeding a predetermined level.

More specifically, the fourth embodiment is arranged to perform the process of "singly rotating the photosensitive drum 1" for two minutes when the fixing device which is controlled to be at a temperature of 200° C. in forming an image is found to be at a temperature not exceeding 100° C. The fixing device is provided with a thermistor for temperature control and is arranged to detect the fixing temperature through the thermistor. The fixing device of the image forming apparatus for use in the fourth embodiment is arranged to take about one hour in lowering its temperature from 200° C. to 100° C. when its ambient atmosphere is at 20° C.

The fourth embodiment is thus arranged to carry out the process of "singly rotating the photosensitive drum 1" as necessary. With the exception of this process, the fourth embodiment is arranged on the basis of the arrangement of the first embodiment. However, the process of "singly rotating the photosensitive drum 1" is of course applicable also to the arrangement of the second embodiment which is arranged to drive the photosensitive drum 1 with the toner layer thickness on the cleaning roller 9*e* arranged to be thin.

Fifth Embodiment

In the case of the above-described first embodiment, during the first mode, as a rule, when the photosensitive drum 1 is driven to make one rotation, the cleaning roller 9*e* is rotated at a circumferential speed of 30 mm/sec and a predetermined amount of toner is supplied from the cleaning roller 9*e* to the nip N of the cleaning blade 9*b* through the surface of the photosensitive drum 1. Further, during the second mode in the case of the above-described first embodiment, the toner is made not to be supplied from the cleaning roller 9*e* to the nip N.

According to a fifth embodiment of the invention, however, the second mode is changed to such operation that the amount of toner to be supplied to the nip N is decreased. That is, in the second mode, into which the image forming apparatus is brought when the atmosphere temperature of the cleaning blade 9*b* is low as in the first embodiment, the amount of toner to be supplied to the nip N is decreased by performing the following operation.

Specifically, with the image forming apparatus arranged as described in the first embodiment, first, the second mode is selected after the main switch of the image forming apparatus is turned on. In this instance, the cleaning roller 9*e* is driven to rotate at a circumferential speed of 3 mm/sec in the direction of arrow Re. Such low-speed rotation of the cleaning roller 9*e* makes it possible to decrease the amount of toner to be supplied to the nip N to about 10% of the amount of toner to be supplied at the ordinary time (in the first mode).

Sixth Embodiment

In the case of the above-described fifth embodiment, when the second mode is selected, the speed of rotation of the cleaning roller 9*e* is reduced. However, in view of the construction of the image forming apparatus, it can be supposed that there is a case where it is difficult to have a plurality of speeds of the cleaning roller 9*e*. In this case, according to a sixth embodiment of the invention, such a construction is employed that the rotation driving of the photosensitive drum 1 and the rotation driving of the cleaning roller 9*e* are effected by individual driving sources, and when the second mode is selected, only the photosensitive drum 1 is made to rotate. Such an operation makes it possible to attain the same advantageous effect as that in the above-described first embodiment. More specifically, while the amount of toner to be supplied to the photosensitive drum 1 is extremely decreased, since the toner with which the cleaning roller 9*e* is coated is made to come into contact with the photosensitive drum 1 at a predetermined nip, toner contributing to forming the nip is gradually conveyed to the nip N between the cleaning blade 9*b* and the photosensitive drum 1 according to the rotation of the photosensitive drum 1.

According to the above operation, it is possible to decrease the amount of toner to be supplied to the nip N to about 0.5% of the amount of toner to be supplied at the ordinary time.

Incidentally, in each of the above-described embodiments, the temperature or humidity inside the image forming apparatus is detected by utilizing a temperature detecting sensor or humidity detecting sensor which is generally used in the conventional image forming apparatus.

According to the arrangement of the invention, as described in the foregoing, the cleaning performance can be stabilized with the elastic member caused to stably abut on the image bearing member by switching from the first mode in which the toner is supplied to the nip between the surface of the image bearing member and the elastic member of the cleaning means over to the second mode in which the toner is not supplied to the nip or the amount of toner to be supplied to the nip is decreased. In addition to that, the arrangement of the invention effectively prevents the fused sticking of the toner due to excessive supply of toner.

What is claimed is:

1. A cleaning device for cleaning an image bearing member comprising:

a cleaning blade abutting against the image bearing member for removing toner from the image bearing member; and transfer means for transferring to the image bearing member the toner removed by the cleaning blade, wherein the transfer means includes a rotary member, which transfers to the image bearing member the toner removed by the cleaning blade, and a restriction member for restricting a layer thickness of the toner on the rotary member before the toner on the rotary member is transferred to a portion of the cleaning blade abutting against the image bearing member, whereby the layer thickness of the toner on the rotary member is changed to change an amount of toner to be transferred to the image bearing member, wherein the amount of toner transferred to the image bearing member by the transfer means is variable while the image bearing member is rotating.

2. A cleaning device according to claim 1, wherein the toner is a magnetic toner and the rotary member transfers the toner by a magnetic force.

3. A cleaning device according to claim 2, wherein the rotary member includes a magnetic member.

4. A cleaning device according to claim 1, wherein the image bearing member includes an electrophotographic photosensitive member.

5. A cleaning device according to claim 1, wherein the cleaning blade abuts against the image bearing member in a direction counter to a rotation direction of the image bearing member.

6. A cleaning device according to claim 1, wherein the amount of toner transferred to the image bearing member is less during a predetermined time starting from a turning on of a main switch of an image forming apparatus, which includes the cleaning device, than an amount of toner after a predetermined time.

7. A cleaning device according to claim 6, wherein the amount of toner transferred to the image bearing member is substantially zero for the predetermined time.

8. A cleaning device for cleaning an image bearing member comprising:

a cleaning blade abutting against the image bearing member for removing toner from the image bearing member; and transfer means for transferring to the image bearing member the toner removed by the cleaning blade, wherein an amount of toner transferred to the image bearing member by the transfer means is variable while the image bearing member is rotating, and wherein the amount of toner transferred to the image bearing member by the transfer means is larger at an ambient temperature above a predetermined temperature than the amount of toner transferred to the image bearing member at an ambient temperature below the predetermined temperature.

9. A cleaning device according to claim 8, wherein the amount of toner transferred to the image bearing member is substantially zero at the ambient temperature below the predetermined temperature.

10. An image forming apparatus comprising:

an image bearing member for bearing a toner image, whereby a toner image on the image bearing member is transferred to an image receiving member;

a cleaning blade abutting against the image bearing member for removing toner from the image bearing member; and transfer means for transferring to the image bearing member the toner removed by the cleaning blade, wherein the transfer means includes a rotary member, which carries the toner removed by the cleaning blade and transfers the toner to the image bearing member, and restriction means for restricting a layer thickness of the toner on the rotary member before the toner on the rotary member is transferred to a portion of the cleaning blade abutting against the image bearing member, whereby the amount of toner transferred to the image bearing member is changed by changing the layer thickness of the toner on the rotary member, and wherein the amount of toner transferred to the image bearing member is variable while the image bearing member is rotating.

11. An image forming apparatus according to claim 10, wherein the toner is a magnetic toner and the rotary member carries and transfers the toner by a magnetic force.

12. An image forming apparatus according to claim 11, wherein the rotary member includes a magnetic member.

13. An image forming apparatus according to claim 10, wherein the image bearing member includes an electrophotographic photosensitive member.

14. An image forming apparatus according to claim 10, wherein the cleaning blade abuts against the image bearing member in a direction counter to a rotation direction of the image bearing member.

15. An image forming apparatus according to claim 10, wherein the amount of toner transferred to the image bearing member is less during a predetermined time starting from a turning on of a main switch of the image forming apparatus than the amount after the predetermined time.

16. An image forming apparatus according to claim 15, wherein the amount of toner transferred to the image bearing member is substantially zero for the predetermined time.

17. An image forming apparatus comprising:

an image bearing member for bearing a toner image, whereby a toner image on the image bearing member is transferred to an image receiving member;

a cleaning blade abutting against the image bearing member for removing the toner from the image bearing member;

transfer means for transferring to the image bearing member the toner removed by the cleaning blade; and detecting means for detecting an ambient temperature, whereby an amount of toner transferred to the image bearing member is changed according to a detection result of the detecting means, wherein the amount of toner transferred to the image bearing member is variable while the image bearing member is rotating.

18. An image forming apparatus according to claim 17, wherein the amount of toner transferred to the image bearing member is less when the detected ambient temperature is below a predetermined temperature than when the detected temperature is above the predetermined temperature.

19. An image forming apparatus according to claim 18, wherein the amount of toner transferred to the image bearing member is substantially zero when the detected temperature is below the predetermined temperature.

20. An image forming apparatus comprising:

an image bearing member for bearing a toner image, whereby a toner image on the image bearing member is transferred to an image receiving member;

a cleaning blade abutting against the image bearing member for removing toner from the image bearing member;

transfer means for transferring to the image bearing member the toner removed by the cleaning blade;

fixing means for fixing the toner image on an image receiving member; and detecting means for detecting a temperature of the fixing means, whereby the amount of the toner transferred to the image bearing member by the transfer means is changed according to a detection result of the detecting means, wherein the amount of toner transferred to the image bearing member is variable while the image bearing member is rotating.

21. An image forming apparatus according to claim 20, wherein the amount of toner transferred to the image bearing member is less when the temperature detected by the detecting means is below the predetermined temperature than when the detected temperature is above the predetermined temperature.

22. An image forming apparatus according to claim 21, wherein the amount of toner transferred to the image bearing member is substantially zero when the temperature detected by the detecting means is below the predetermined temperature.

23. A cleaning device for cleaning an image bearing member, comprising:

a cleaning blade, which removes a toner from the image bearing member by abutment with the image bearing member; and a rotary member, which transfers to the image bearing member the toner removed by the cleaning blade, wherein a peripheral speed of the rotary member is variable while the image bearing member is rotating.

24. A cleaning device according to claim 23, wherein the toner transferred to the image bearing member by the rotary member is transferred to a portion of the cleaning blade abutting against the image bearing member.

25. A cleaning device according to claim 23, wherein the toner is a magnetic toner, and the rotary member transfers the toner by a magnetic force.

26. A cleaning device according to claim 25, wherein the rotary member includes a magnetic member.

27. A cleaning device according to claim 23, wherein the image bearing member includes an electrophotographic photosensitive member.

28. A cleaning device according to claim 23, wherein the cleaning blade abuts against the image bearing member in a direction counter to a rotation direction of the image bearing member.

29. A cleaning device according to any one of claims 23–28, wherein a peripheral speed of the rotary member for a predetermined time starting from a turning on of a main switch of an image forming apparatus, which includes the cleaning device, is slower than the peripheral speed after the predetermined time.

30. A cleaning device according to claim 29, wherein the peripheral speed of the rotary member is zero for the predetermined time.

31. A cleaning device according to any one of claims 23–28, wherein a peripheral speed of the rotary member is slower when an ambient temperature is below a predetermined temperature than when the ambient temperature is above the predetermined temperature.

32. A cleaning device according to claim 31, wherein the peripheral speed of the rotary member is zero when the ambient temperature is below the predetermined temperature.

33. An image forming apparatus, comprising:

an image bearing member for carrying a toner image, whereby the toner image on the image bearing member is transferred to an image receiving member;

a cleaning blade for removing the toner from the image bearing member by abutment with the image bearing member; and a rotary member for transferring the toner removed by the cleaning blade to the image bearing member, wherein a peripheral speed of the rotary member is variable while the image bearing member is rotating.

34. An image forming apparatus according to claim 33, wherein the toner transferred to the image bearing member is transferred to a portion of the cleaning blade abutting against the image bearing member.

35. An image forming apparatus according to claim 33, wherein the toner is a magnetic toner and the rotary member transfers the toner by a magnetic force.

36. An image forming apparatus according to claim 35, wherein the rotary member includes a magnetic member.

37. An image forming apparatus according to claim 33, wherein the image bearing member includes an electrophotographic photosensitive member.

38. An image forming apparatus according to claim 33, wherein the cleaning blade abuts against the image bearing member in a direction counter to a rotation direction of the image bearing member.

39. An image forming apparatus according to any one of claims 33–38, wherein a peripheral speed of the rotary member is slower for a predetermined time starting from a turning on of a main switch of the image forming apparatus than the peripheral speed after the predetermined time.

40. An image forming apparatus according to claim 39, wherein the peripheral speed of the rotary member is zero for the predetermined time.

41. An image forming apparatus according to any one of claims 33–38, further comprising detecting means for detecting an ambient temperature, whereby the peripheral speed of the rotary member is changed according to a detection result of the detecting means.

42. An image forming apparatus according to claim 41, wherein the peripheral speed of the rotary member is slower when the temperature detected by the detecting means is below the predetermined temperature than when the detected temperature is above the predetermined temperature.

43. An image forming apparatus according to any one of claims 33–38, further comprising fixing means for fixing the toner image on the image receiving member and detecting means for detecting a temperature of the fixing means, whereby a peripheral speed of the rotary member is changed according to a detection result of the detecting means.

44. An image forming apparatus according to claim 43, wherein the peripheral speed of the rotary member is slower when the temperature detected by the detecting means is below the predetermined temperature than when the detected temperature is above the predetermined temperature.

45. An image forming apparatus according to claim 44, wherein the peripheral speed of the rotary member is zero when the temperature detected by the detecting means is below the predetermined temperature.

46. An image forming apparatus, comprising:

an image bearing member for bearing a toner image;

developing means for forming a toner image on the image bearing member, whereby the toner image on the image bearing member is transferred to an image receiving member;

a cleaning blade abutting against the image bearing member for removing the toner from the image bearing member; and transfer means for transferring to the image bearing member the toner removed by the cleaning blade, wherein the cleaning blade and the transfer means are disposed toward a downstream side in a moving direction of the image bearing member from the developing means, wherein the toner transferred to the image bearing member by the transfer means is transferred to a portion of the cleaning blade abutting against the image bearing member, and wherein the amount of toner transferred to the image bearing member is variable while the image bearing member is rotating.

* * * * *